US011519258B2

(12) United States Patent
Helms et al.

(10) Patent No.: US 11,519,258 B2
(45) Date of Patent: Dec. 6, 2022

(54) PRESSURE TESTING CASING STRING DURING REVERSE CEMENTING OPERATIONS

(71) Applicant: Halliburton Energy Services, Inc., Houston, TX (US)

(72) Inventors: Lonnie Carl Helms, Houston, TX (US); Jinhua Cao, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 17/080,992

(22) Filed: Oct. 27, 2020

(65) Prior Publication Data

US 2022/0127948 A1 Apr. 28, 2022

(51) Int. Cl.

| | |
|---|---|
| ***E21B 47/00*** | (2012.01) |
| ***E21B 47/005*** | (2012.01) |
| ***E21B 34/14*** | (2006.01) |
| ***E21B 47/06*** | (2012.01) |
| ***E21B 47/007*** | (2012.01) |

(52) U.S. Cl.

CPC ..... *E21B 47/005* (2020.05); *E21B 34/142* (2020.05); *E21B 47/007* (2020.05); *E21B 47/06* (2013.01)

(58) Field of Classification Search

CPC ..... E21B 47/005; E21B 47/007; E21B 47/06; E21B 21/10

See application file for complete search history.

(56) References Cited

U.S. PATENT DOCUMENTS

| | | | | |
|---|---|---|---|---|
| 4,469,174 | A | 9/1984 | Freeman | |
| 5,494,107 | A | 2/1996 | Bode | |
| 5,890,538 | A * | 4/1999 | Beirute | E21B 21/10 166/285 |
| 2004/0084182 | A1* | 5/2004 | Edgar | E21B 21/10 166/285 |
| 2006/0042798 | A1 | 3/2006 | Badalamenti et al. | |
| 2007/0095533 | A1* | 5/2007 | Rogers | E21B 33/14 166/285 |
| 2009/0020285 | A1* | 1/2009 | Chase | E21B 33/14 166/285 |
| 2013/0264068 | A1* | 10/2013 | Hanson | E21B 33/13 166/373 |
| 2017/0370186 | A1* | 12/2017 | Stair | E21B 34/14 |
| 2018/0238139 | A1 | 8/2018 | Gao et al. | |

* cited by examiner

*Primary Examiner* — Christopher J Sebesta
(74) *Attorney, Agent, or Firm* — Sheri Higgins Law, PLLC; Sheri Higgins

(57) ABSTRACT

A method of pressure testing a casing string in a reverse cementing operation in a wellbore can include: introducing the casing string and a downhole tool installed within the casing string into the wellbore, wherein the downhole tool comprises a fluid flow path defined by an inner diameter of the downhole tool; introducing a cement composition into an annulus located between a wall of the wellbore and an outside of the casing string; causing the fluid flow path of the downhole tool to close against fluid flow from the annulus into at least a portion of the casing string; and increasing pressure within the portion of the casing string that is closed against fluid flow from the annulus. The fluid flow path can be closed by shifting an inner sleeve to close a flapper valve or flow ports, a bridge plug, a packer, or a ball and a ball seat.

20 Claims, 6 Drawing Sheets

PRESSURE TESTING CASING STRING DURING REVERSE CEMENTING OPERATIONS

TECHNICAL FIELD

The field relates to pressure testing a casing string during reverse cementing in an oil or gas operation. A fluid flow path through the casing string can be closed before, during, or after the conclusion of the reverse cementing operation to allow pressure testing of the casing string to occur.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
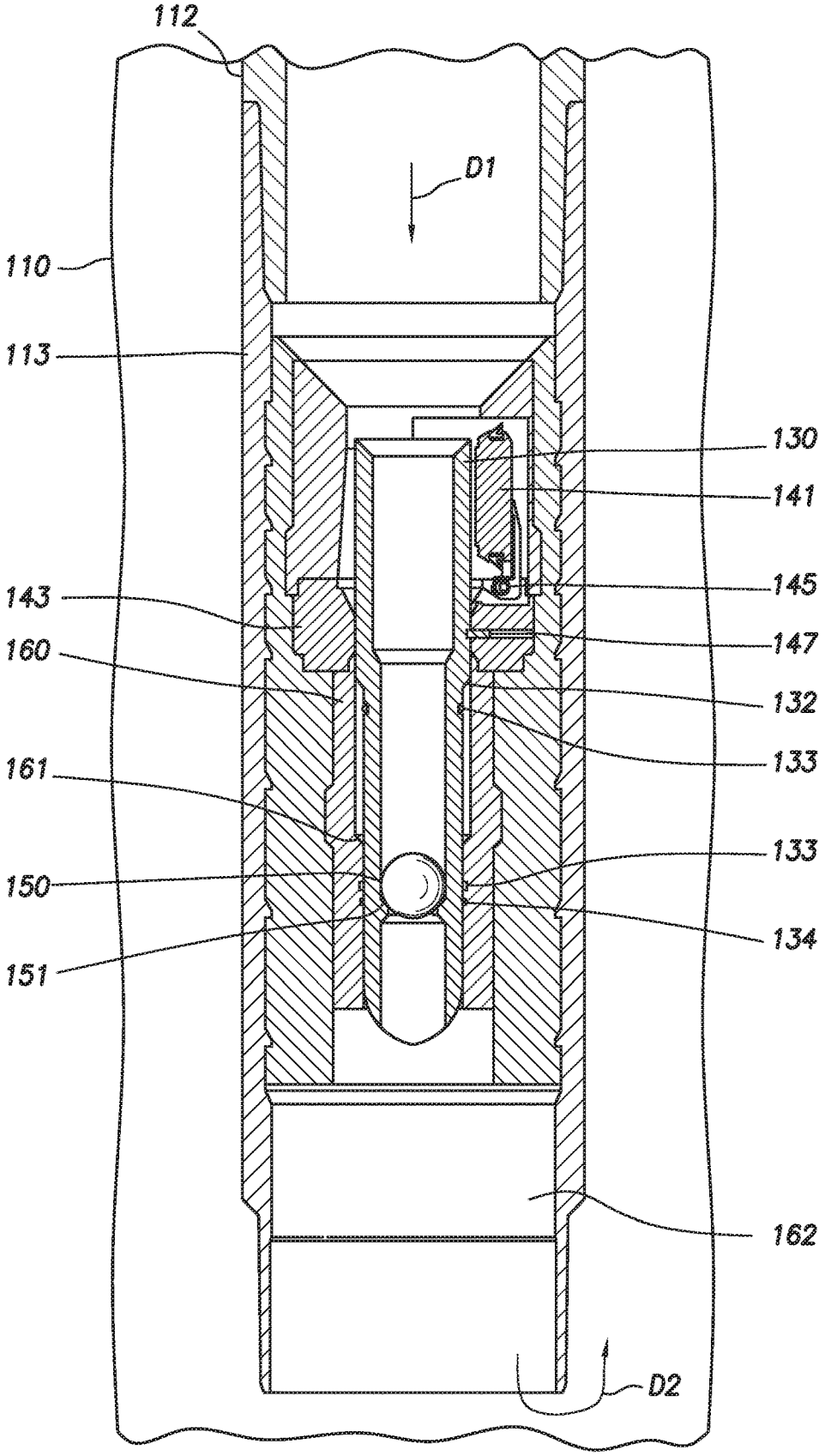
FIG. 1 illustrates a downhole tool during run in with a flapper valve in an open position according to certain embodiments.

Oil and gas hydrocarbons are naturally occurring in some subterranean formations. In the oil and gas industry, a subterranean formation containing oil and/or gas is referred to as a reservoir. A reservoir can be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

During well completion, it is common to introduce a cement composition into an annulus in a wellbore. For example, in a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing. As used herein, a "cement composition" is a mixture of at least cement and water, and possibly other additives.

As used herein, a "cement composition" is a mixture of at least cement and water. A cement composition can include additives. As used herein, the term "cement" means an initially dry substance that develops compressive strength or sets in the presence of water. Some examples of cements include, but are not limited to, Portland cements, gypsum cements, high alumina content cements, slag cements, high magnesia content cements, sorel cements, and combinations thereof. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore.

In traditional cementing operations, a spacer fluid is typically introduced after the drilling fluid into the casing. The spacer fluid pushes the drilling fluid through the casing and up into an annular space towards a wellhead. A cement composition is then introduced after the spacer fluid into the casing.

A cement composition should remain pumpable during introduction into a wellbore. A cement composition will ultimately set after placement into the wellbore. As used herein, the term "set," and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days. The compressive strength of a cement composition can reach over 10,000 psi (69 MPa).

Reverse cementing operations were developed to overcome some of the disadvantages to traditional cement operations. For example, in traditional cementing operations, the setting time of the cement composition is longer in order for the cement slurry to travel through the casing or an inner tubing string and back up into the annulus before setting. Additionally, the amount of cement slurry that is pumped is generally greater than in reverse cementing. In reverse cementing, the cement slurry is pumped directly into the annulus instead of into the annulus via the casing string or tubing string. Accordingly, reverse cementing generally requires less of the cement slurry, faster setting times, and lower pump pressures because gravity assists the cement slurry in being placed in the annulus.

After the cement composition has been placed at the desired location in an annulus, it is common to pressure test the casing to verify the structural integrity of the casing. During the pressure testing, the casing string tends to radially expand from the pressure inside the casing string. In cementing operations, the cement slurry may begin to set before pressure testing can be performed. If the cement slurry is beginning to set and not in liquid form, then a micro-annulus can form along the outer diameter of the casing string due to the expansion of the casing during the pressure testing and retraction after the pressure testing is concluded. The mostly- to partially-set cement slurry is unable to flow back into the void created by the expansion and retraction of the casing string. If a micro-annulus forms, then fluid can undesirably flow through the micro-annulus. Therefore, pressure testing of the casing is typically performed days after the cement slurry has been placed to allow the cement slurry to completely set and prevent formation of a micro-annulus.

The inability to perform pressure testing during or shortly after a cementing operation undesirably leads to increased costs due to downtime waiting for the cement composition to fully set and delays the pressure testing and other wellbore operations. Thus, there is a need for improved ways to pressure test a casing string in a reverse cementing operation that requires less time and money.

A downhole tool can be used to perform a reverse cementing operation and pressure test a casing string before, during, or shortly after the conclusion of the reverse cementing operation. The downhole tool can include a fluid flow path through the inner diameter of the tool. The fluid flow path can be closed before, during, or after a reverse cementing operation. Closure of the fluid flow path allows for pressure testing of the casing string to be performed. The pressure testing is performed while the cement composition is in a fluid state and is less likely to form a micro-annulus.

Methods of pressure testing a casing string in a reverse cementing operation in a wellbore comprises: introducing the casing string and a downhole tool installed within the casing string into the wellbore, wherein the downhole tool comprises a fluid flow path defined by an inner diameter of the downhole tool; introducing a cement composition into an annulus located between a wall of the wellbore and an outside of the casing string; causing the fluid flow path of the downhole tool to close against fluid flow from the annulus into the downhole tool; and increasing pressure within the casing string.

It is to be understood that the discussion of any of the embodiments regarding the downhole tool is intended to apply to all of the method embodiments. Any reference to the unit "gallons" means U.S. gallons.

Figure 2:
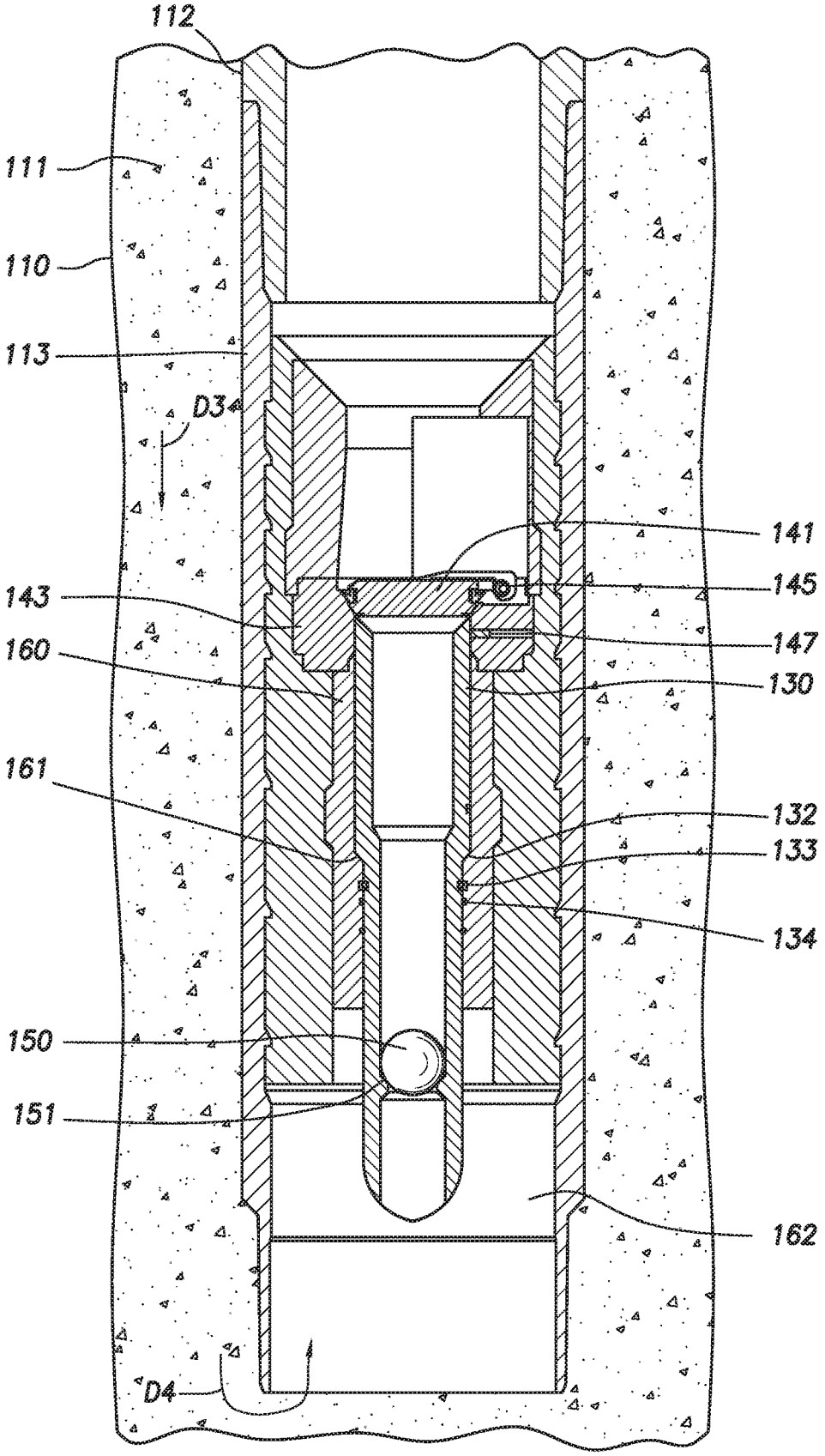
FIG. 2 illustrates the downhole tool during a reverse cementing operation with the flapper valve in a closed position according to certain embodiments.

Turning to the figures, FIGS. 1 and 2 illustrate closing of a fluid flow path using a flapper valve. The downhole tool 100 of FIG. 1 is shown during introduction into a wellbore—commonly known in the industry as being run-in. The downhole tool 100 includes a body 113. The body 113 can be configured to fit within a casing string 112, for example, via casing box X pin connectors. The casing string 112 and the downhole tool 100 can be introduced into a wellbore that is defined by a wellbore wall 110. An annulus can be defined as the space located between the wellbore wall 110 and the outside of the casing string 112 and body 113.

The downhole tool 100 can include an inner sleeve 130 and a valve connector housing 160. The inner sleeve 130 can be releasably attached to the valve connector housing 160 by a frangible device 147. The frangible device 147 can be any device that is capable of withstanding a predetermined amount of force and capable of releasing at a force above the predetermined amount of force. The frangible device 147 can be, for example, a shear pin, a shear screw, a shear ring, a load ring, a lock ring, a pin, or a lug. There can also be more than one frangible device 147 that connects the inner sleeve 130 to the valve connector housing 160. The frangible device 147 or multiple frangible devices can be selected based on the force rating of the device, the total number of devices used, and the predetermined amount of force needed to release the device. For example, if the total force required to break or shear the frangible device is 15,000 pounds force ($lb_f$) and each frangible device has a rating of 5,000 $lb_f$, then a total of three frangible devices may be used.

The downhole tool 100 can include a valve 141. The valve 141 can be a flapper valve. As shown in FIG. 1, the downhole tool is shown in the run-in position wherein the valve 141 is in an open position. In practice, drilling mud is usually introduced along with the casing string 112 and the downhole tool from a wellhead in the direction D1. With the valve 141 held in the open position during run-in via the inner sleeve 130, the run-in fluid (e.g., a drilling mud) can flow within a fluid flow path through the body 120 in the direction D1. The run-in fluid can then enter the annulus in the direction D2. The inner sleeve 130 can also include a sealing element 134 that restricts or prevents fluid flow between the outside of the inner sleeve 130 and the inside of the valve connector housing 160.

Figure 3:
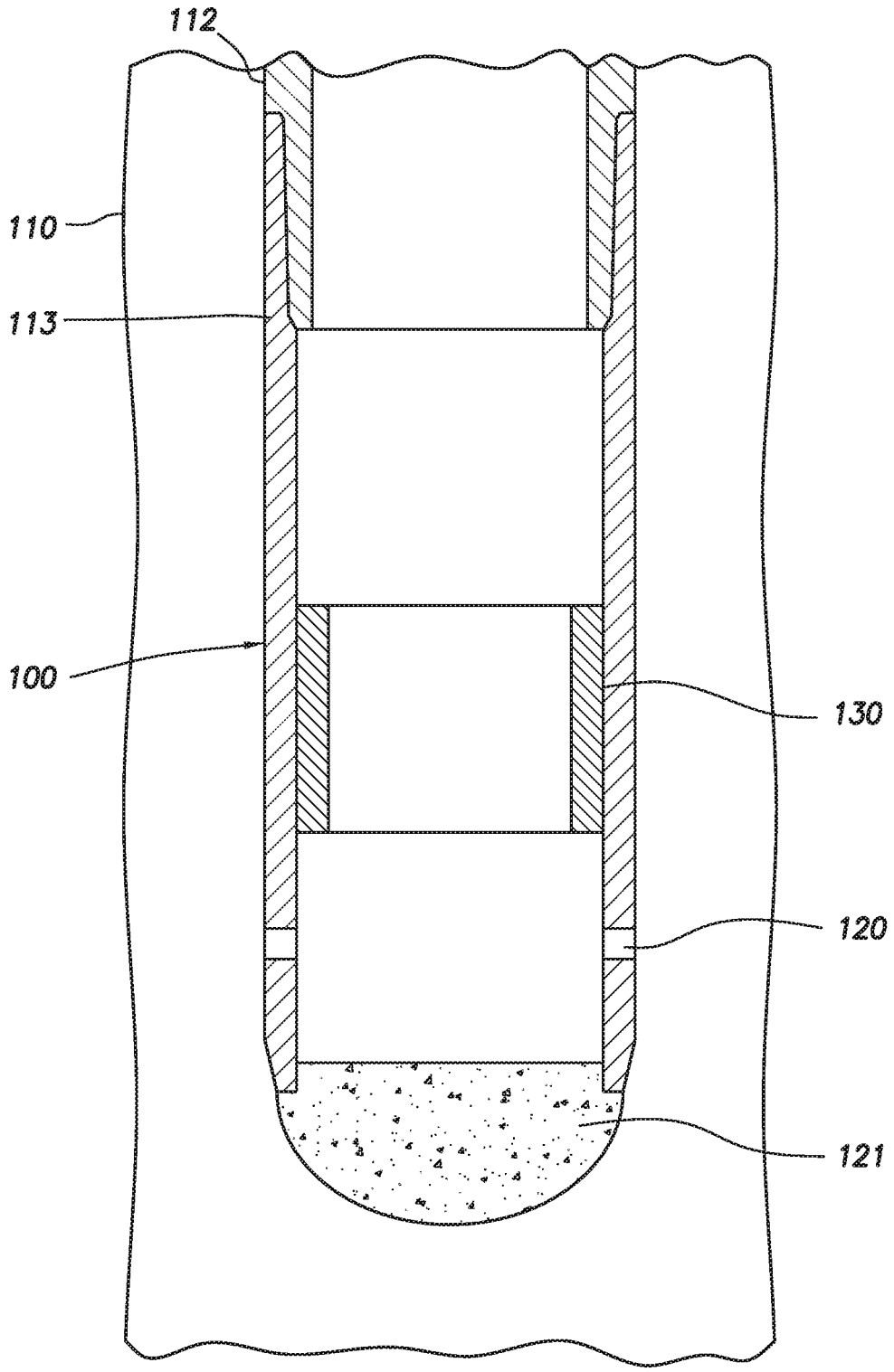
FIG. 3 illustrates the downhole tool showing a sleeve in a pre-shifted position and fluid flow ports open according to certain embodiments.
Figure 4:
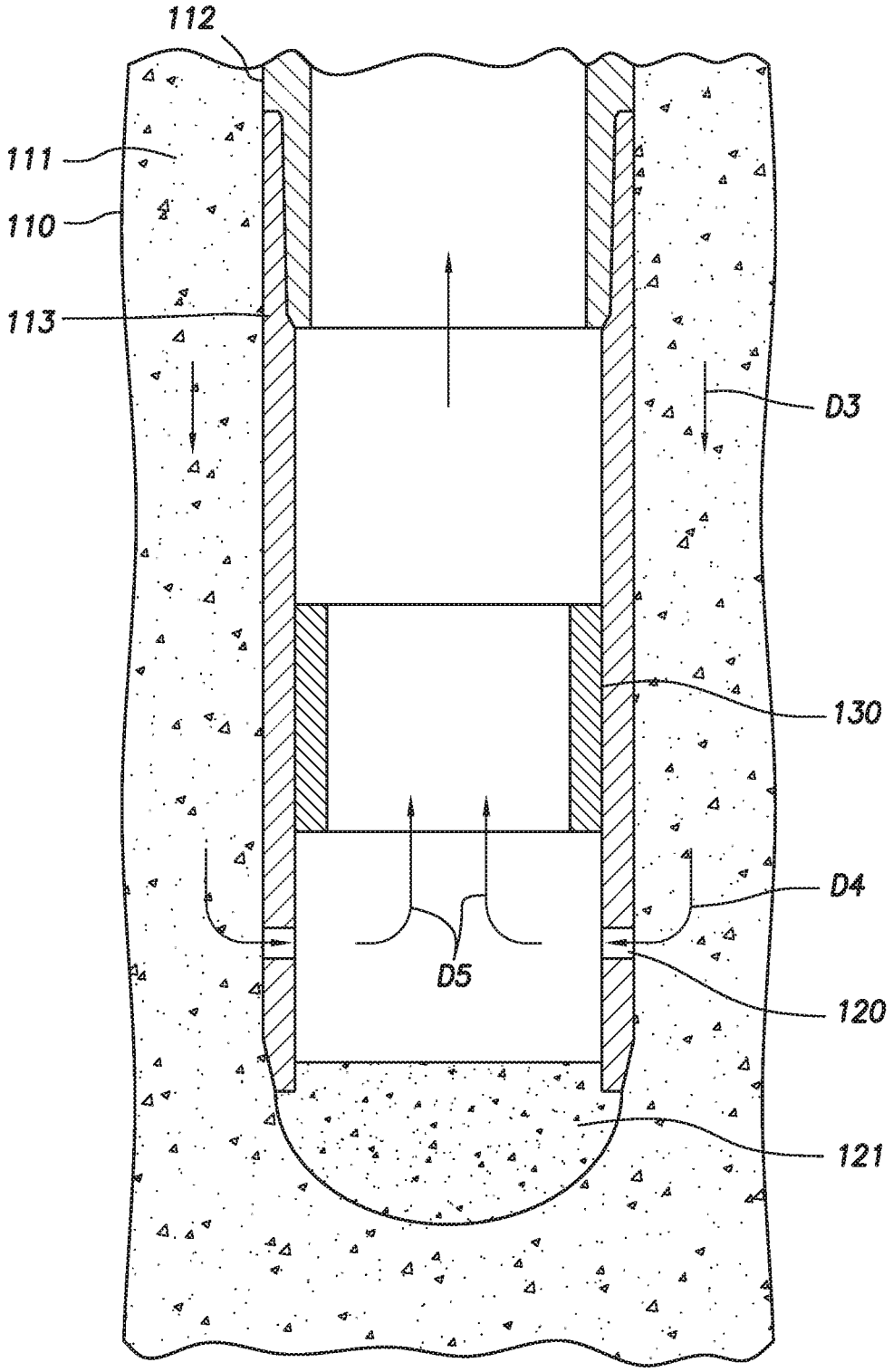
FIG. 4 illustrates the downhole tool of FIG. 3 during a reverse cementing operation.
Figure 5:
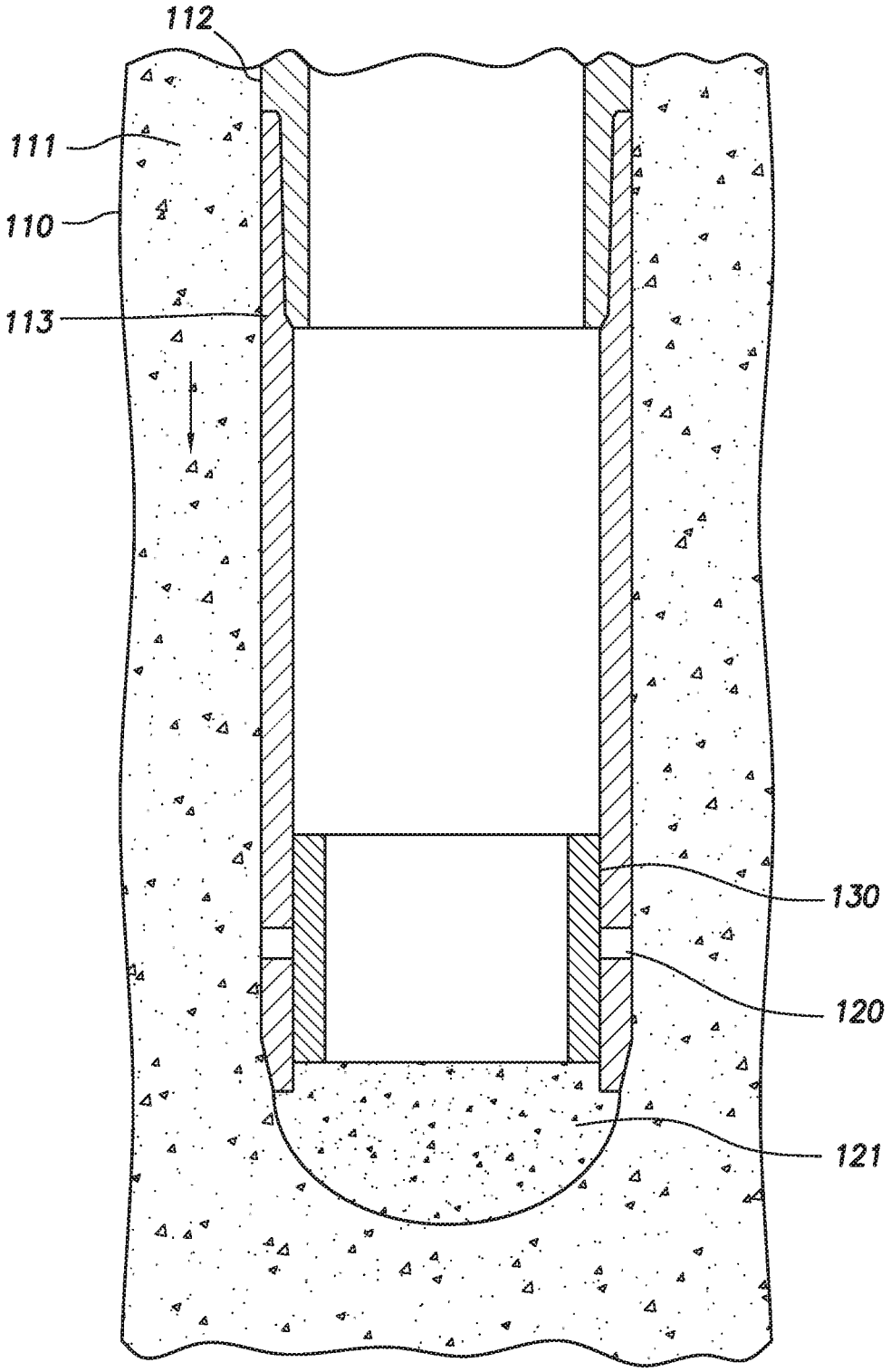
FIG. 5 illustrates the downhole tool of FIG. 3 showing the sleeve in a shifted position and fluid flow ports closed.

FIGS. 3-5 illustrate a downhole tool 100 including a sleeve 130 and one or more flow ports 120 for closing the fluid flow path. There can be two or more flow ports 120 located around the periphery of the body of the downhole tool near the bottom of the body. The flow ports 120 can have a variety of shapes and dimensions selected in part on the desired volume of fluid flow through the ports. The sleeve 130 can be located above the flow ports 120 when the sleeve is in a pre-shifted position. FIG. 3 shows the downhole tool 100 in the run-in position with the sleeve is in the pre-shifted position. The downhole tool 100 can also include a nose 121. The nose 121 can be made from a drillable material that can be milled or drilled out to allow fluid flow through the bottom of the downhole tool.

The methods include closing the fluid flow path through the downhole tool 100. As shown in FIGS. 1 and 2, the inner sleeve 130 can be shifted after introduction and placement of the casing string 112 and the downhole tool into the wellbore. As shown in FIG. 5, the sleeve 130 can be shifted after introduction of the cement composition 111 into the annulus.

With reference to FIGS. 4 and 5, the cement composition 111 can be circulated through the annulus located between the wellbore wall 110 and the outside of the casing string 112 in the direction D3 and flow through the flow ports 120 in the direction D4 and into the downhole tool 100 in the direction D5. After the reverse cementing operation is completed, the sleeve 130 can be shifted to make contact with a sealed end of the downhole tool 100 or the nose 121. Shifting of the sleeve 130 closes the flow ports 120 thereby closing the fluid flow path through the downhole tool 100 and allowing pressure testing of the casing string 112.

The sleeve 130 can be shifted via a variety of mechanisms. By way of example and as shown in FIGS. 1 and 2, the downhole tool can include a ball seat 151 that is located on the inner sleeve 130. After the downhole tool has been placed at the desired location within the wellbore, a ball 150 can be introduced into the casing string 112 and be flowed through the inner sleeve 130 of the downhole tool. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Shifting of the inner sleeve 130 can be accomplished via a ball and seat by dropping the ball from the wellhead onto the seat that is located within the downhole tool. The ball 150 engages with the ball seat 151, and the seal created by this engagement prevents fluid communication downstream of the ball and seat. A pressure differential is created after the seal is created by engagement of the ball 150 with the ball seat 151. The pressure differential can cause the frangible device 147 to shear, thereby releasing the inner sleeve 130 from connection with the valve connector housing 160.

Turning now to FIG. 2, the inner sleeve 130 is caused to move downward within the body 120 due to the pressure differential and shearing of the frangible device 147. The inner sleeve 130 can continue to travel in a downward direction until a sleeve shoulder 132 shoulders up against a valve connector housing shoulder 161. Continued travel of the inner sleeve 130 is prevented after the sleeve shoulder 132 engages with the valve connector housing shoulder 161. The inner sleeve 130 and the valve connector housing 160 can also include a lock ring 133. The lock ring 133 can become locked as shown in FIG. 2 after shouldering occurs. Locking of the lock ring 133 can help secure the inner sleeve 130 from further movement within the body 120.

As can also be seen in FIG. 2, the downward movement of the inner sleeve 130 into the shifted position can cause the valve 141 to convert from an open position into a closed position. As the inner sleeve 130 moves downward, a flapper of the valve 141 is no longer held open by the inner sleeve 130 and can rotate into the closed position via a hinge 145 located on a first valve body 143. Movement of the flapper into the closed position closes the fluid flow path through the downhole tool 100 from fluid flowing in the direction D1. Closure of the fluid flow path allows pressure testing to be performed. One advantage to using the flapper valve embodiments shown in FIGS. 1 and 2 is the valve can be closed before, during, or shortly after a reverse cementing operation. Cement flowing through the annulus in the direction D3 and entering the downhole tool 100 in the direction D4 can cause the flapper of the valve 141 to partially open. However, cessation of introduction of the cement composition will allow the flapper to move back to the closed position via a spring wrapped around the valve hinge pin, for example.

With continued reference to FIGS. 1-5, the sleeve 130 can be mechanically or hydraulically actuated to cause shifting of the sleeve to cause the flapper valve to close or the flow ports 120 to close. Although not shown in the drawings, other downhole tool 100 components can be included for mechanical actuation of the sleeve, for example, exposure of an atmospheric chamber to a sleeve held in place by an incompressible fluid and shifted due to a differential area, releasing of the contents of a pressurized chamber to a piston driving a sleeve to the closed position, and applying a pressure pulse through the pumps to initiate a servo driven motor to shift the sleeve closed.

By way of another example, electro-mechanical sifting of the sleeve can be used. A magnetic permeability sensing apparatus ("sensing apparatus") can be used for activating devices downhole based on magnetic permeability sensing, including shifting the sleeve 130 during reverse cementing operations. At designated stages of reverse cementing operations, a material with high magnetic permeability can be added to the cement composition to be sent downhole to enable a magnetic sensor to detect the magnetic permeability of the slurry. The sensing apparatus is situated downhole near a flow port to detect the presence of the cement composition with known magnetic permeability corresponding to the cement composition sent downhole and to send a signal to close a valve (e.g., a sliding sleeve, ball valve, etc.) either at the flow port or across the cross section of the casing string 112. Once the known cement composition is detected, an additional signal (e.g., a wired signal through electric line or fiber optics, or a wireless signal such as a pressure rise, an acoustic signal, etc.) is sent by the sensing apparatus to a controller of the reverse cementing operations at the surface to stop flow of the current slurry and/or commence flow of a different slurry. In one application, the additional signal is a pressure rise associated with the increased flow resistance from the valve closing. The sensing apparatus can include a magnet source (e.g., a permanent magnet or an electromagnet) and a magnetic sensor. The sensing apparatus can be configured to detect specific ranges of magnetic permeability by inducing a magnetic field in the cement composition to be read by the magnetic sensor. The magnetic sensor can detect different cement compositions downhole based on different concentrations of the high magnetic permeability material in the cement composition, which results in magnetic fields with different strengths at the sensor. This sensing apparatus can detect multiple types of cementing fluids using accurate measurements of magnetic permeability.

By way of yet another example, a valve, such as a ball valve or safety valve, can be programmed to close the fluid flow path through the casing string 112 at a predetermined time. For example, the valve can be programmed to close the fluid flow path at the conclusion of the reverse cementing operation.

Figure 6:
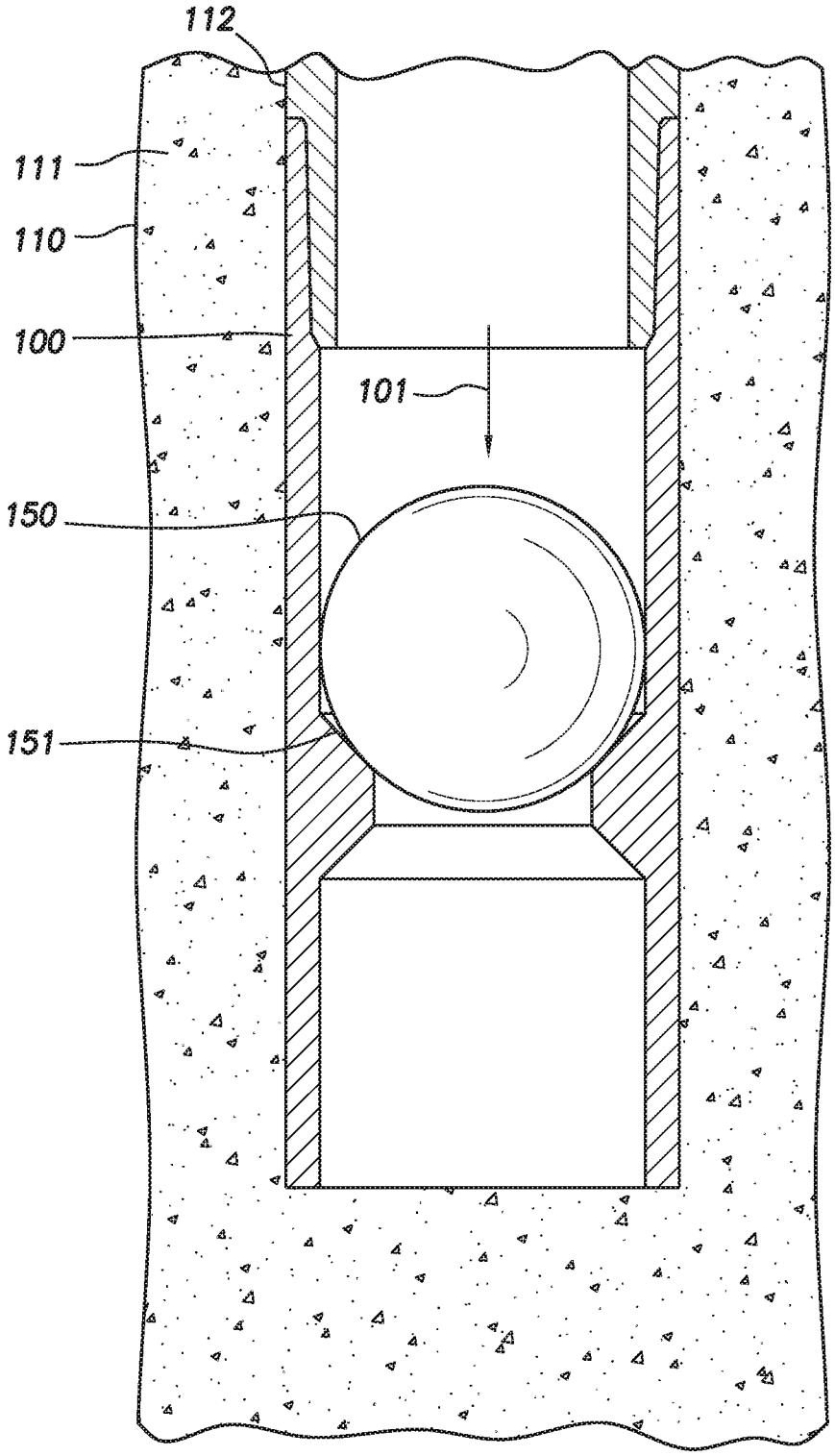
FIG. 6 illustrates a downhole tool including a ball and a ball seat for closing a fluid flow path through the tool.

FIG. 6 shows closure of the fluid flow path through the downhole tool 100 using a ball 150 and a ball seat 151. Landing of the ball 150 onto the ball seat 151 can occur at the conclusion of the reverse cementing operation and closes the fluid flow path through the downhole tool 100 to allow pressure testing to be performed. According to these embodiments, the specifics (e.g., the dimensions and manufacturing material) of the ball 150 and the ball seat 151 can be selected such that the pressure rating of the ball engagement is greater than or equal to the desired pressure of the pressure testing. Because pumping of the ball into the casing string is not possible without displacing the cement composition, the ball 150 can free fall onto the ball seat 151 due to gravity. The embodiments shown in FIG. 6 may be useful in substantially vertical wellbore operations when landing of the ball 150 can occur in a time less than the gelation time of the cement composition (e.g., when the ball seat is located a maximum distance from the wellhead such that the ball can seat in a short amount of time). In this manner, pressure testing can commence before the cement composition has reached sufficient gel strength or compressive strength, which could cause a micro-annulus to form.

It is to be understood that although FIG. 6 shows closure of the fluid flow path via a ball and a ball seat, other downhole tool components can be utilized instead of the ball and ball seat. By way of non-limiting examples, closure of the fluid flow path can also be accomplished with a bridge plug, a packer, or other well servicing downhole tools. A bridge plug or packer can be installed at a desired location within the casing string 112, for example, via wireline, tubing string, drill pipe, or casing string. The ball, bridge plug, or packer can include dissolvable materials for removal from the wellbore after pressure testing. The components can also be milled out or retrieved from the wellbore using a retrieval tool.

The components of the downhole tool can be made from a variety of materials including, but not limited to, metals, metal alloys, composites, plastics, and rubbers. Other components can also be included, for example, components required for safety and/or regulatory requirements.

The methods include introducing a cement composition 111 into an annulus located between a wall 110 of the wellbore and an outside of the casing string 112. The annulus and inside of the casing string 112 can contain a fluid. The fluid can be a run-in fluid, for example, a drilling mud. The methods can include introducing a first fluid into the annulus prior to introduction of the cement composition 111. The first fluid can be a spacer fluid. A spacer fluid can help separate a drilling mud from the cement composition 111. The cement composition 111 can then be introduced into the annulus. There can also be a second, third, etc. fluid, such as a tail cement composition or a cement composition containing a different concentration of the high magnetic permeability material, introduced into the annulus after the cement composition 111. Any of the fluids can be introduced into the annulus in the direction D3 and can enter the downhole tool in the direction D5.

The methods further include increasing pressure within the casing string from the surface via drilling rig pumps or other service provider pumps. One of the many advantages to the novel methods is that pressure testing can be performed before, during, or shortly after the cement composition(s) have been introduced into the wellbore annulus. The cement composition(s) can be in a fluid form. As used herein, the term "fluid form" means the cement composition can flow and conform to the outline of a container. It is to be understood that a cement composition in "fluid form" may begin to gel, develop compressive strength, and/or set; however, any gelation, development of compressive strength, and/or setting should not be so significant as to reduce the ability of the cement composition to flow and conform to the outline of a container. A cement composition in fluid form enables pressure testing to be performed at this stage of the reverse cementing operation without formation of a micro-annulus. This advantageous capability can significantly reduce costs and time.

According to any of the embodiments, an overbalanced wellbore is achieved after introduction of the cement composition 111. A wellbore segment can have a specific hydrostatic pressure. The hydrostatic pressure in the wellbore segment can be pre-determined. As used herein, "hydrostatic pressure" is the force per unit area exerted by a column of wellbore fluid at rest. In U.S. oilfield units, hydrostatic pressure is calculated using the equation: P=MW*Depth*0.052, where MW is the drilling fluid density in pounds per gallon, Depth is the true vertical depth or "head" in feet, and 0.052 is a unit conversion factor chosen such that P results in units of pounds per square inch (psi). The hydrostatic pressure is the force exerted on the wellbore components, such as a tubing string or casing, or a subterranean formation for an open-hole wellbore portion, via the fluid located in the wellbore or in a tubing string. According to these embodiments, an overbalanced wellbore exists when the hydrostatic pressure of the column of fluid in the annulus is less than the hydrostatic pressure of the column of fluid in the casing string.

The density of any fluids introduced before the cement composition as well as the density of the cement composition can be selected such that an overbalanced wellbore is achieved. There can also be a second cement composition that is introduced into the annulus. For example, a first cement composition, such as a lead cement slurry, can be introduced into the annulus—followed by a second cement composition, such as a tail cement slurry that has a different density. The following is one, non-limiting example of a density design of fluids to achieve hydrostatic equilibrium. A 9 pound per gallon (ppg) drilling mud can be located within the casing and annulus. A higher density spacer fluid, for example 12 ppg, can be pumped into the annulus when the reverse cementing operation begins. The heavier weight spacer fluid pushes the lighter weight drilling mud through the annulus in the direction D3. A lead cement slurry with a higher density than the drilling mud, but lighter than the spacer fluid, for example 11 ppg, can be pumped into the annulus. The lead cement will remain on top of the spacer fluid and allow the spacer fluid to continue pushing the drilling mud through the annulus and can enter the casing string 112 in the direction D4. A tail cement slurry can have a density equal to or less than the lead cement slurry, for example 10 ppg. After placement of all of the cement slurries in the annulus, hydrostatic equilibrium can be achieved with the column of fluid in the annulus having a combined average density of 10.5 ppg and the column of fluid in the casing string having a combined average density of 10.5 ppg. One of ordinary skill in the art will be able to select the density and volume of the fluids in order to achieve hydrostatic equilibrium or an overbalance.

An embodiment of the present disclosure is a method of pressure testing a casing string in a reverse cementing operation in a wellbore comprising: introducing the casing string and a downhole tool installed within the casing string into the wellbore, wherein the downhole tool comprises a fluid flow path defined by an inner diameter of the downhole tool; introducing a cement composition into an annulus located between a wall of the wellbore and an outside of the casing string; causing the fluid flow path of the downhole tool to close against fluid flow from the annulus into at least a portion of the casing string; and increasing pressure within the portion of the casing string that is closed against fluid flow from the annulus. Optionally, the method further comprises wherein the fluid flow path of the downhole tool is closed by shifting of an inner sleeve. Optionally, the method further comprises wherein shifting of the inner sleeve is accomplished via a ball and a ball seat, mechanical actuation of the inner sleeve, hydraulic actuation of the inner sleeve, or electro-mechanical actuation of the inner sleeve. Optionally, the method further comprises wherein the downhole tool further comprises: a flapper valve located on an inside of a body of the downhole tool, wherein the flapper valve is in an open position prior to shifting of the inner sleeve; or two or more flow ports located around a periphery of a body of the downhole tool, wherein the two or more flow ports are in an open position and the inner sleeve is located above the two or more flow ports prior to shifting of the inner sleeve. Optionally, the method further comprises wherein shifting of the inner sleeve causes a flapper of the flapper valve to move into a closed position or wherein shifting of the inner sleeve causes the two or more flow ports to move into a closed position. Optionally, the method further comprises wherein the downhole tool further comprises a ball seat located on an inner diameter of the inner sleeve. Optionally, the method further comprises dropping a ball from a wellhead onto the ball seat. Optionally, the method further comprises wherein the ball engages with the ball seat and a pressure differential is created after a seal is created by engagement of the ball with the ball seat. Optionally, the method further comprises wherein the pressure differential causes the inner sleeve to shift. Optionally, the method further comprises wherein the downhole tool further comprises a valve connector housing releasably connected to the inner sleeve by a frangible device, and wherein the pressure differential causes the frangible device to shear and releases the inner sleeve from connection with the valve connector housing. Optionally, the method further comprises wherein the downhole tool further comprises a valve located within the inner diameter of the downhole tool. Optionally, the method further comprises wherein the valve is programmed to close at a predetermined time, and wherein closure of the valve closes the fluid flow path. Optionally, the method further comprises wherein the downhole tool further comprises a ball seat located on an inner diameter of the inner sleeve. Optionally, the method further comprises dropping a ball from a wellhead onto the ball seat. Optionally, the method further comprises wherein the ball engages with the ball seat and closes the fluid flow path through the downhole tool. Optionally, the method further comprises wherein closure of the fluid flow path is accomplished using a bridge plug or a packer. Optionally, the method further comprises wherein the step of increasing pressure within the portion of the casing string comprises pumping a fluid from a wellhead into the portion of the casing string using a pump. Optionally, the method further comprises introducing a fluid into the annulus located between the wall of the wellbore and the outside of the casing string before introduction of the cement composition. Optionally, the method further comprises introducing a second cement composition into the annulus located between the wall of the wellbore and the outside of the casing string after introduction of the cement composition. Optionally, the method further comprises creating an overbalanced wellbore, wherein the hydrostatic pressure of a column of fluid located in the annulus is less than the hydrostatic pressure of a column of fluid in the portion of the casing string.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more fluids, valves, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a–b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of pressure testing a casing string in a reverse cementing operation in a wellbore comprising:

introducing the casing string and a downhole tool installed within the casing string into the wellbore, wherein the downhole tool comprises a fluid flow path defined by an inner diameter of the downhole tool;

introducing a cement composition into an annulus located between a wall of the wellbore and an outside of the casing string;

causing the fluid flow path of the downhole tool to close against fluid flow from the annulus into at least a portion of the casing string; and pressure testing the casing string by increasing pressure within the portion of the casing string that is closed against fluid flow from the annulus, wherein the pressure testing is performed when the cement composition is in a fluid form.

2. The method according to claim 1, wherein the fluid flow path of the downhole tool is closed by shifting of an inner sleeve.

3. The method according to claim 2, wherein the downhole tool further comprises a flapper valve located on an inside of a body of the downhole tool, wherein the flapper valve is in an open position prior to shifting of the inner sleeve.

4. The method according to claim 3, wherein shifting of the inner sleeve causes a flapper of the flapper valve to move into a closed position, wherein shifting of the inner sleeve is accomplished via a ball and a ball seat, and wherein the flapper valve moves into the closed position prior to introduction of the cement composition.

5. The method according to claim 4, wherein the downhole tool further comprises a ball seat located on an inner diameter of the inner sleeve.

6. The method according to claim 5, further comprising pumping or dropping a ball from a wellhead onto the ball seat, wherein the ball engages with the ball seat and a pressure differential is created after a seal is created by engagement of the ball with the ball seat.

7. The method according to claim 6, wherein the pressure differential causes the inner sleeve to shift.

8. The method according to claim 7, wherein the downhole tool further comprises a valve connector housing releasably connected to the inner sleeve by a frangible device, and wherein the pressure differential causes the frangible device to shear and releases the inner sleeve from connection with the valve connector housing.

9. The method according to claim 3, wherein shifting of the inner sleeve causes a flapper of the flapper valve to move into a closed position, wherein shifting of the inner sleeve is accomplished via mechanical actuation of the inner sleeve, hydraulic actuation of the inner sleeve, or electro-mechanical actuation of the inner sleeve.

10. The method according to claim 2, wherein the downhole tool further comprises two or more flow ports located around a periphery of a body of the downhole tool, wherein the two or more flow ports are in an open position and the inner sleeve is located above the two or more flow ports prior to shifting of the inner sleeve.

11. The method according to claim 10, wherein shifting of the inner sleeve is accomplished via mechanical actuation of the inner sleeve, hydraulic actuation of the inner sleeve, or electro-mechanical actuation of the inner sleeve.

12. The method according to claim 10, wherein shifting of the inner sleeve occurs after introduction of the cement composition.

13. The method according to claim 1, wherein the step of increasing pressure within the portion of the casing string comprises pumping a fluid from a wellhead into the portion of the casing string using a pump.

14. The method according to claim 1, further comprising introducing a fluid into the annulus prior to introduction of the cement composition.

15. The method according to claim 1, further comprising introducing a second cement composition into the annulus after introduction of the cement composition.

16. The method according to claim 1, further comprising creating an overbalanced wellbore, wherein a hydrostatic pressure of a column of fluid located in the annulus is less than a hydrostatic pressure of a column of fluid in the portion of the casing string.

17. A method of pressure testing a casing string in a reverse cementing operation in a wellbore comprising:

introducing the casing string and a downhole tool installed within the casing string into the wellbore, wherein the downhole tool comprises:

a fluid flow path defined by an inner diameter of the downhole tool; and a valve located within the inner diameter of the downhole tool, wherein the valve is programmed to close at a predetermined time, and wherein closure of the valve closes the fluid flow path;

introducing a cement composition into an annulus located between a wall of the wellbore and an outside of the casing string;

causing the fluid flow path of the downhole tool to close against fluid flow from the annulus into at least a portion of the casing string; and pressure testing the casing string by increasing pressure within the portion of the casing string that is closed against fluid flow from the annulus, wherein the pressure testing is performed when the cement composition is in a fluid form.

18. A method of pressure testing a casing string in a reverse cementing operation in a wellbore comprising:

introducing the casing string and a downhole tool installed within the casing string into the wellbore, wherein the downhole tool comprises:

a fluid flow path defined by an inner diameter of the downhole tool; and a ball seat located on an inner diameter of the downhole tool;

dropping a ball from a wellhead onto the ball seat, and wherein the ball free falls onto the ball seat due to gravity;

introducing a cement composition into an annulus located between a wall of the wellbore and an outside of the casing string;

causing the fluid flow path of the downhole tool to close against fluid flow from the annulus into at least a portion of the casing string; and pressure testing the casing string by increasing pressure within the portion of the casing string that is closed against fluid flow from the annulus, wherein the pressure testing is performed when the cement composition is in a fluid form.

19. The method according to claim 18, wherein the ball engages with the ball seat and closes the fluid flow path through the downhole tool.

20. The method according to claim 18, wherein the wellbore is a vertical wellbore, and wherein the ball is dropped after introduction of the cement composition.

* * * * *